US011845121B2

(12) United States Patent
Saika et al.

(10) Patent No.: US 11,845,121 B2
(45) Date of Patent: Dec. 19, 2023

(54) METAL PIPE FORMING METHOD, METAL PIPE, AND FORMING SYSTEM

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP); Kimihiro Nogiwa, Ehime (JP); Akihiro Ide, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 217 days.

(21) Appl. No.: 17/383,103

(22) Filed: Jul. 22, 2021

(65) Prior Publication Data

US 2021/0346933 A1 Nov. 11, 2021

Related U.S. Application Data

(63) Continuation of application No. PCT/JP2020/004985, filed on Feb. 7, 2020.

(30) Foreign Application Priority Data

Mar. 5, 2019 (JP) ..... 2019-039830

(51) Int. Cl.
*B21D 22/02* (2006.01)
*B21D 22/06* (2006.01)
(Continued)

(52) U.S. Cl.
CPC ..... *B21D 22/025* (2013.01); *B21D 22/022* (2013.01); *B21D 22/06* (2013.01)

(58) Field of Classification Search
CPC .... B21D 15/03; B21D 26/033; B21D 26/037; B21D 26/041; B21D 26/04326; B21D 26/045; B21D 26/047
See application file for complete search history.

(56) References Cited

U.S. PATENT DOCUMENTS 9,643,661 B2 5/2017 Kosaka
2010/0186477 A1 7/2010 Barthelemy et al.
(Continued)

FOREIGN PATENT DOCUMENTS

JP 2006-122979 A 5/2006
JP 2006122979 A * 5/2006
(Continued)

OTHER PUBLICATIONS

English translate (JP2006122979A), retrieved date Apr. 18, 2023.*
(Continued)

*Primary Examiner* — Matthew Katcoff
*Assistant Examiner* — Mohammed S. Alawadi
(74) *Attorney, Agent, or Firm* — Michael Best & Friedrich LLP

(57) ABSTRACT

A metal pipe forming method includes: disposing a metal pipe material having a hollow shape between a pair of dies; and forming a metal pipe including a pipe portion and a flange portion by expanding the metal pipe material by supplying a fluid and bringing the metal pipe material into contact with the pair of dies. In the forming of the metal pipe, a gap which is positioned between a pair of inner surfaces of the flange portion and communicates with an internal space of the pipe portion is formed, and the flange portion is provided with a through-hole connected to the gap.

12 Claims, 9 Drawing Sheets

(51) Int. Cl.

| | |
|---|---|
| ***B21D 19/08*** | (2006.01) |
| ***B21D 26/047*** | (2011.01) |
| ***B21D 37/16*** | (2006.01) |
| ***B21D 26/035*** | (2011.01) |
| ***B21D 13/02*** | (2006.01) |

(56) References Cited

U.S. PATENT DOCUMENTS

| | | | | |
|---|---|---|---|---|
| 2017/0120317 | A1* | 5/2017 | Ishizuka ..... | B21D 26/043 |
| 2019/0344321 | A1 | 11/2019 | Nogiwa et al. | |

FOREIGN PATENT DOCUMENTS

| | | | | |
|---|---|---|---|---|
| JP | 2009220141 | A | * | 10/2009 |
| JP | 2012-000654 | A | | 1/2012 |
| JP | 2013-158785 | A | | 8/2013 |
| JP | 2013158785 | A | * | 8/2013 |
| JP | 2016-064702 | A | | 4/2016 |
| WO | 2018-168259 | A1 | | 9/2018 |

OTHER PUBLICATIONS

English translate (JP2009220141A), retrieved date Apr. 18, 2023.*
English translate (JP2013158785A), retrieved date Apr. 19, 2023.*
International Search Report issued in Application No. PCT/JP2020/004985, dated Apr. 14, 2020.
Search Report issued in European Application No. 20765942.6, dated Mar. 14, 2022.

* cited by examiner

METAL PIPE FORMING METHOD, METAL PIPE, AND FORMING SYSTEM

RELATED APPLICATIONS

The contents of Japanese Patent Application No. 2019-039830, and of International Patent Application No. PCT/JP2020/004985, on the basis of each of which priority benefits are claimed in an accompanying application data sheet, are in their entirety incorporated herein by reference.

BACKGROUND

Technical Field

A certain embodiment of the present invention relates to a metal pipe forming method, a metal pipe, and a forming system.

Description of Related Art

In the related art, a forming apparatus for forming a metal pipe including a pipe portion and a flange portion by supplying a gas into a heated metal pipe material and expanding the material is known. For example, the related art discloses a forming apparatus including: upper and lower dies to be paired with each other; a gas supply portion that supplies a gas into a metal pipe material held between the upper and lower dies; a heating mechanism that heats the metal pipe material; and a cavity portion formed by combining the upper and lower dies.

SUMMARY

According to an embodiment of the present disclosure, there is provided a metal pipe forming method including: disposing a metal pipe material having a hollow shape between a pair of dies; and forming a metal pipe including a pipe portion and a flange portion by expanding the metal pipe material by supplying a fluid and bringing the metal pipe material into contact with the pair of dies. In the forming of the metal pipe, a gap which is positioned between a pair of inner surfaces of the flange portion and communicates with an internal space of the pipe portion is formed, and the flange portion is provided with a through-hole connected to the gap.

According to another embodiment of the present disclosure, there is provided a metal pipe including: a pipe portion having a hollow shape; and a flange portion integrated with the pipe portion. The flange portion has a pair of inner surfaces and a through-hole, a gap that communicates with an internal space of the pipe portion is positioned between the pair of inner surfaces, and the through-hole is connected to the gap.

According to still another embodiment of the present disclosure, there is provided a metal pipe forming system including: a forming unit that forms a metal pipe including a pipe portion and a flange portion by disposing a metal pipe material having a hollow shape between a pair of dies, expanding the metal pipe material by supplying a fluid, and bringing the metal pipe material into contact with the pair of dies; and a processing unit that provides a through-hole in the metal pipe, in which the forming unit forms a gap which is positioned between a pair of inner surfaces of the flange portion and communicates with an internal space of the pipe portion, and the processing unit provides a through-hole connected to the gap in the flange portion.

DETAILED DESCRIPTION

Figure 1:
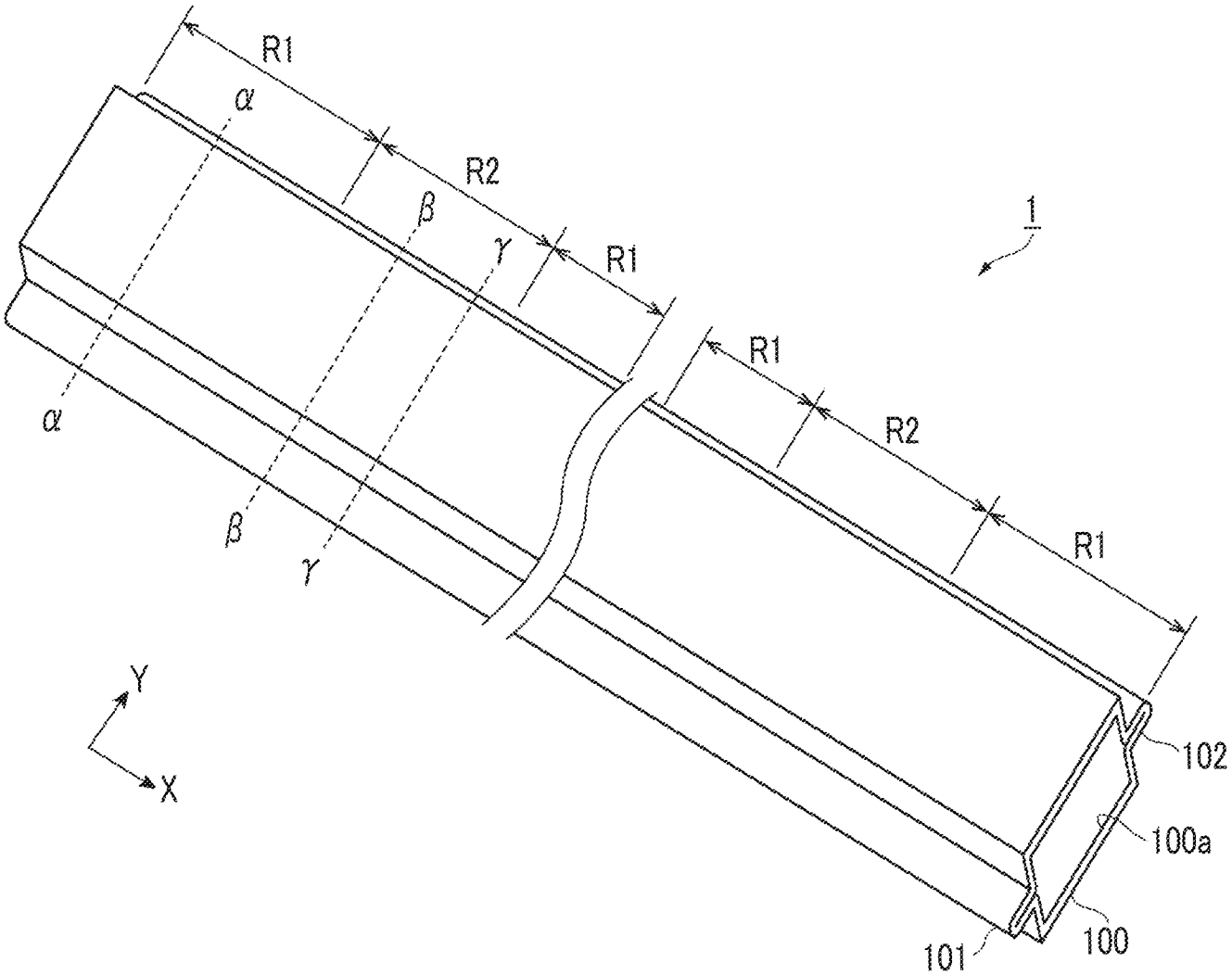
FIG. 1 is a schematic view showing a metal pipe.

A metal pipe formed by using the forming apparatus shown in the related art exhibits a seamless hollow shape. In a case where a liquid such as water has entered such a metal pipe, the liquid is less likely to be discharged from the metal pipe. Therefore, rust may occur on the metal pipe in which the liquid is collected. Therefore, countermeasures against rust on the metal pipe as described above are required.

It is desirable to provide a metal pipe forming method, a metal pipe, and a forming system capable of suppressing the generation of rust.

According to the metal pipe forming method, in the forming of the metal pipe, a gap which is positioned between the pair of inner surfaces of the flange portion and communicates with an internal space of the pipe portion is formed. The flange portion is provided with a through-hole connected to the gap. Accordingly, for example, even in a case where a liquid such as water has entered the internal space of the pipe portion, the liquid can be easily discharged through the gap and the through-hole. Thereby, the liquid is less likely to be collected inside the metal pipe, and thus, the generation of rust on the metal pipe can be suppressed.

In the forming of the metal pipe, a plurality of the gaps which are positioned between the pair of inner surfaces and intermittently disposed along an axial direction of the pipe portion may be formed, and the pair of inner surfaces may be in close contact with each other between the gaps adjacent to each other along the axial direction. In this case, a portion where the pair of inner surfaces are in close contact with each other, and another member can be spot-welded. In addition, by the formation of the plurality of gaps inside the flange portion, the liquid is less likely to be collected in the internal space of the pipe portion. Therefore, it is possible to suppress the occurrence of intensity deterioration of the pipe portion, which is the main body of the metal pipe.

The flange portion may be provided with the through-hole for each of the plurality of gaps. In this case, it is possible to excellently suppress the collection of liquid inside the metal pipe.

The gap may be continuously provided along the axial direction of the pipe portion, and the pair of inner surfaces may be partially in close contact with each other. In this case, the part where the pair of inner surfaces are in close contact with each other and another member can be spot-welded. Even in a case where the number of through-holes formed in the flange portion is reduced, the liquid can be excellently discharged through the gap and the through-hole.

In this metal pipe, the gap that communicates with the internal space of the pipe portion is positioned between the pair of inner surfaces of the flange portion. The through-hole is connected to the gap. Accordingly, for example, even in a case where a liquid such as water has entered the internal space of the pipe portion, the liquid can be easily discharged through the gap and the through-hole. Thereby, the liquid is less likely to be collected inside the metal pipe, and thus, the generation of rust on the metal pipe can be suppressed.

According to the forming system, it is possible to obtain the action and effects having the same meaning as those of the above-described forming method.

Hereinafter, a preferred embodiment of a metal pipe according to an aspect of the present disclosure, a forming method thereof, and a forming system will be described with reference to the drawings. In addition, in each drawing, the same reference numerals are assigned to the same portions or the corresponding portions, and repeated descriptions thereof are omitted.

Figure 2A:
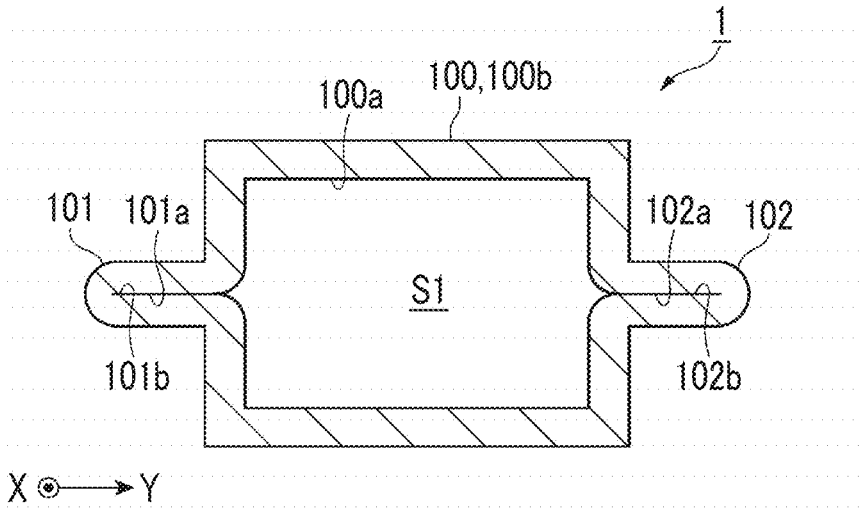
FIG. 2A is a sectional view taken along line α-α of FIG. 1.
Figure 2B:
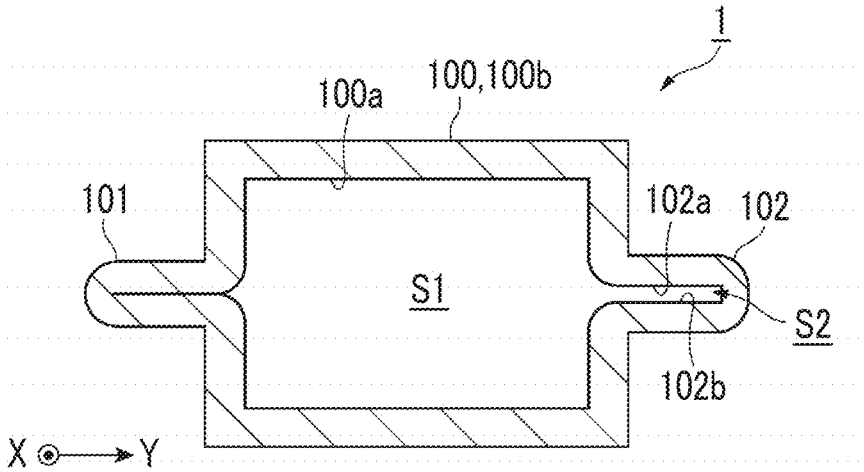
FIG. 2B is a sectional view taken along line β-β of FIG. 1.
Figure 2C:
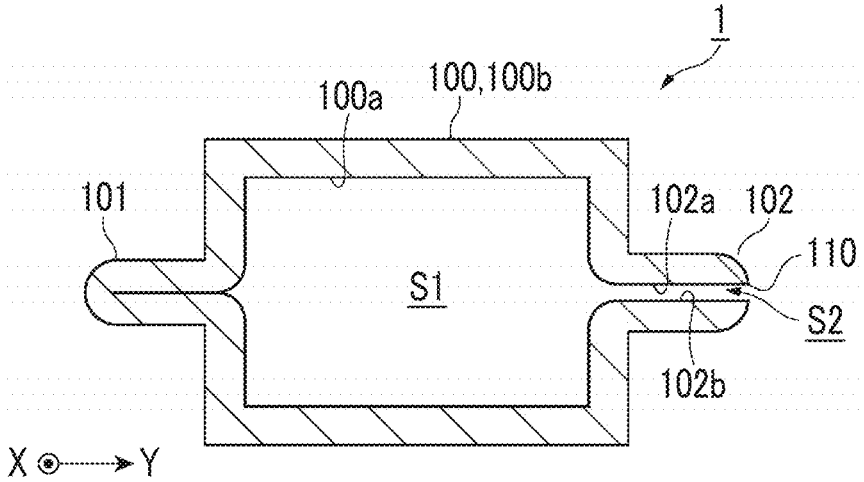
FIG. 2C is a sectional view taken along line γ-γ of FIG. 1.

FIG. 1 is a schematic perspective view showing a metal pipe according to the present embodiment. FIG. 2A is a sectional view taken along line α-α of FIG. 1, FIG. 2B is a sectional view taken along line β-β of FIG. 1, and FIG. 2C is a sectional view taken along line γ-γ of FIG. 1. A metal pipe 1 shown in FIGS. 1 and 2A to 2C is a hollow member used for a reinforcing member mounted on a vehicle such as an automobile, an aggregate of the vehicle, or the like, and is an elongated member that extends along the axial direction. The metal pipe 1 according to the present embodiment includes one metal pipe material. In other words, the metal pipe 1 is not formed by welding a plurality of sheet metals, nor is it formed by processing a single sheet metal (for example, roll forming or the like). Therefore, there is no joint in the cross section of the metal pipe 1. The metal pipe material is, for example, a tubular member made of high tension steel or ultrahigh tension steel. High tension steel is a steel material that exhibits a tensile intensity of 400 MPa or more. Ultrahigh tension steel is a steel material that exhibits a tensile intensity of 1 GPa or more. The thickness of the metal pipe 1 is not particularly limited, but is, for example, 1.0 mm or more and 2.3 mm or less. Hereinafter, as shown in FIG. 1 or the like, an axial direction of the metal pipe 1 is a longitudinal direction X, and a direction perpendicular to the longitudinal direction X is a transverse direction Y.

The metal pipe 1 includes a pipe portion 100 and flange portions 101 and 102. The pipe portion 100 is a main body having a hollow shape, and has, for example, a substantially square cross section. An internal space S1 is defined by an inner peripheral surface 100*a* of the pipe portion 100. In the present embodiment, each of the inner peripheral surface 100*a* and the outer peripheral surface 100*b* of the pipe portion 100 has a planar shape, but the present disclosure is not limited thereto. From the viewpoint of improvement of withstanding intensity, irregularities or the like may be appropriately provided in the pipe portion 100.

The flange portion 101 is a protrusion portion that protrudes from the pipe portion 100 along the transverse direction Y. The flange portion 101 is provided along the longitudinal direction X. In the present embodiment, the dimension of the flange portion 101 in the longitudinal direction X is substantially the same as the dimension of the pipe portion 100 in the longitudinal direction X. The flange portion 101 is formed by folding a portion that protrudes from the pipe portion 100. Therefore, the flange portion 101 and the pipe portion 100 are seamlessly integrated with each other. From the viewpoint of welding and the like, the protrusion amount of the flange portion 101 is, for example, 1 mm or more and 100 mm or less. The tip of the flange portion 101 is rounded, but the present disclosure is not limited thereto.

The flange portion 102 is a protrusion portion that protrudes from the pipe portion 100 along the transverse direction Y, and is provided on the opposite side of the flange portion 101 through the pipe portion 100 in the transverse direction Y. Similar to the flange portion 101, the flange portion 102 is provided along the longitudinal direction X. The flange portion 102 is also formed by folding a portion that protrudes from the pipe portion 100. Therefore, the flange portion 102 and the pipe portion 100 are seamlessly integrated with each other. From the viewpoint of welding and the like, the protrusion amount of the flange portion 102 is, for example, 1 mm or more and 100 mm or less. The tip of the flange portion 102 is rounded, but the present disclosure is not limited thereto.

As shown in FIGS. 2A to 2C, the pair of inner surfaces 101*a* and 101*b* of the flange portion 101 are in close contact with each other without any gap as a whole. As shown in FIG. 2A, some portions of the pair of inner surfaces 102*a* and 102*b* of the flange portion 102 are in close contact with each other without a gap. The location where the pair of inner surfaces 102*a* and 102*b* are in close contact with each other functions as, for example, a spot-welded portion between the metal pipe 1 and another member. In the present embodiment, the pair of inner surfaces 102*a* and 102*b* are in close contact with each other in a region R1 shown in FIG. 1.

As shown in FIGS. 2B and 2C, the other portions of the pair of inner surfaces 102*a* and 102*b* are separated from each other. In other words, between the pair of inner surfaces 102*a* and 102*b* of the flange portion 102, unlike the flange portion 101, a gap S2 that communicates with the internal space S1 of the pipe portion 100 is positioned. In the present embodiment, the pair of inner surfaces 102*a* and 102*b* are separated from each other in a region R2.

The regions R1 and R2 are provided alternately with each other in the longitudinal direction X. Therefore, a plurality of gaps S2 are formed in the metal pipe 1, and the plurality of gaps S2 are intermittently disposed along the longitudinal direction X. Of the dimensions of the metal pipe 1 in the longitudinal direction X, a ratio of the dimensions of the region R1 in the longitudinal direction X is, for example 90% or less. Of the dimensions of the metal pipe 1 in the longitudinal direction X, a ratio of the dimensions of the region R2 in the longitudinal direction X is, for example 10% or more and 50% or less.

As shown in FIG. 2C, the flange portion 102 has a through-hole 110. The through-hole 110 is an opening provided so as to be connected to the gap S2. Accordingly, for example, in a case where water has entered the internal space S1, the water can be discharged to the outside of the metal pipe 1 through the through-hole 110. For example, when the metal pipe 1 is immersed in the coating liquid, the through-hole 110 becomes an air escape hole. Accordingly, the inner peripheral surface 100*a* and the like of the pipe portion 100 can be excellently coated. In addition, it is possible to suppress the occurrence of collection of the coating liquid on the inner peripheral surface 100*a* or the like. The through-hole 110 is provided at any location in the region R2. The through-holes 110 may be provided in each of the plurality of regions R2, or may be provided in at least one of the plurality of regions R2. A plurality of through-holes 110 may be provided in one region R2. In a case where the plurality of through-holes 110 are provided in the flange portion 102, the interval between the through-holes 110 may be constant in the longitudinal direction X.

In the present embodiment, the through-hole 110 is provided at the tip of the flange portion 102, but the present disclosure is not limited thereto. The through-hole 110 may be provided at the lowermost location (that is, the location where the liquid is most likely to be collected) in the flange portion 102. Therefore, for example, in a case where the flange portion 102 in the metal pipe 1 is positioned at the lowermost, the through-hole 110 may be provided at the most protruding portion in the flange portion 102. The shape of the flange portion 102 may be adjusted so that the liquid can easily reach the through-hole 110. For example, the inner surfaces 102*a*, 102*b*, and the like of the flange portion 102 may be bent, or the inner surfaces 102*a*, 102*b*, and the like may be provided with a gradient.

Next, a forming method of the metal pipe 1 according to the present embodiment will be described with reference to FIGS. 3 to 7. First, a forming apparatus for forming the metal pipe 1 will be described with reference to FIGS. 3 to 5B.

Configuration of Forming Apparatus

Figure 3:
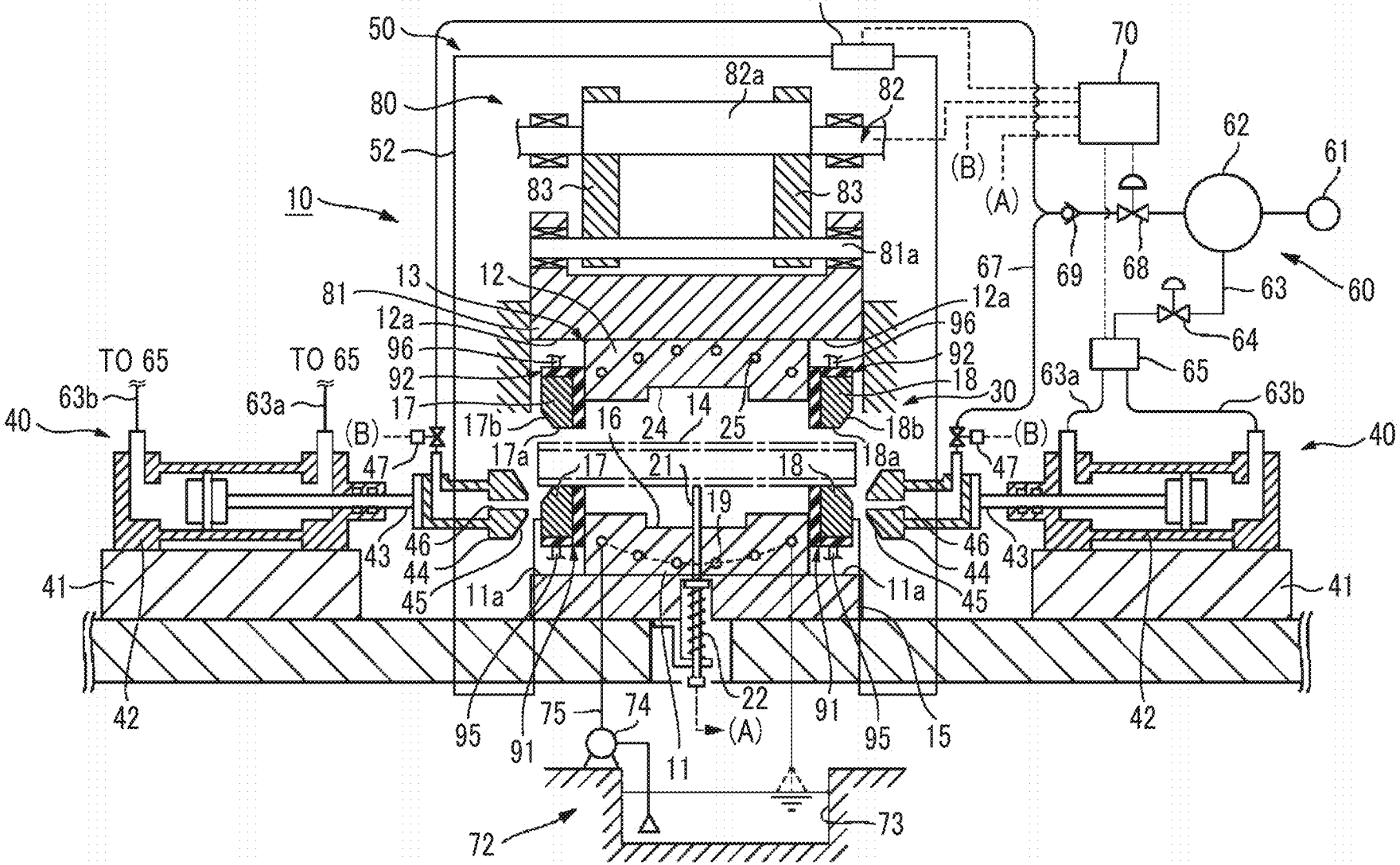
FIG. 3 is a schematic sectional view of a forming apparatus according to an embodiment.

FIG. 3 is a schematic configuration view of the forming apparatus. As shown in FIG. 3, a forming apparatus 10 for forming a metal pipe includes a forming die (forming unit) 13 including an upper die (die) 12 and a lower die (die) 11 to be paired with each other, a drive mechanism 80 which moves at least one of the upper die 12 and the lower die 11, a pipe holding mechanism 30 which holds a metal pipe material 14 disposed between the upper die 12 and the lower die 11, a heating mechanism 50 which energizes the metal pipe material 14 held by the pipe holding mechanism 30 to heat the metal pipe material 14, a gas supply unit 60 for supplying a gas into the metal pipe material 14 which is held between the upper die 12 and the lower die 11 and is heated, a pair of gas supply portions 40 and 40 for supplying the gas from the gas supply unit 60 into the metal pipe material 14 held by the pipe holding mechanism 30, and a water circulation mechanism 72 which forcibly water-cools the forming die 13, and a controller 70 which controls driving of the drive mechanism 80, driving of the pipe holding mechanism 30, driving of the heating mechanism 50, and gas supply of the gas supply unit 60. In the following, the metal pipe refers to a hollow article after forming is completed by the forming apparatus 10, and the metal pipe material 14 refers to a hollow article before forming is completed by the forming apparatus 10.

The forming die 13 is a die used for forming the metal pipe material 14 into the metal pipe. Therefore, each of the lower die 11 and the upper die 12 included in the forming die 13 is provided with a cavity (recessed part) in which the metal pipe material 14 is accommodated (details thereof will be described later).

The lower die 11 is fixed to a large base stage 15. The lower die 11 is configured with a large steel block and includes a cavity 16 on an upper surface of the lower die 11, for example. A cooling water passage 19 is formed in the lower die 11. Further, the lower die 11 includes a thermocouple 21 inserted from below substantially at the center. The thermocouple 21 is supported to be movable upward or downward by a spring 22. The thermocouple 21 is merely an example of temperature measurement means, and may be a non-contact type temperature sensor such as a radiation thermometer or an optical thermometer. When the correlation between the energization time and the temperature can be obtained, the temperature measurement means may be omitted.

An electrode storage space 11*a* is provided in the vicinity of the left and right ends (left and right ends in FIG. 3) of the lower die 11. In the electrode storage space 11*a*, electrodes (lower electrodes) 17 and 18 configured to be capable of advancing and retreating upward and downward are provided. Insulating materials 91 for preventing energization are respectively provided between the lower die 11 and the lower electrode 17 and under the lower electrode 17, and between the lower die 11 and the lower electrode 18 and under the lower electrode 18. Each of the insulating materials 91 is fixed to an advancing and retreating rod 95, which is a movable portion of an actuator (not shown) that configures the pipe holding mechanism 30. The actuator is for moving the lower electrodes 17 and 18 or the like upward or downward and a fixation portion of the actuator is held on the base stage 15 side together with the lower die 11.

Figure 4A:
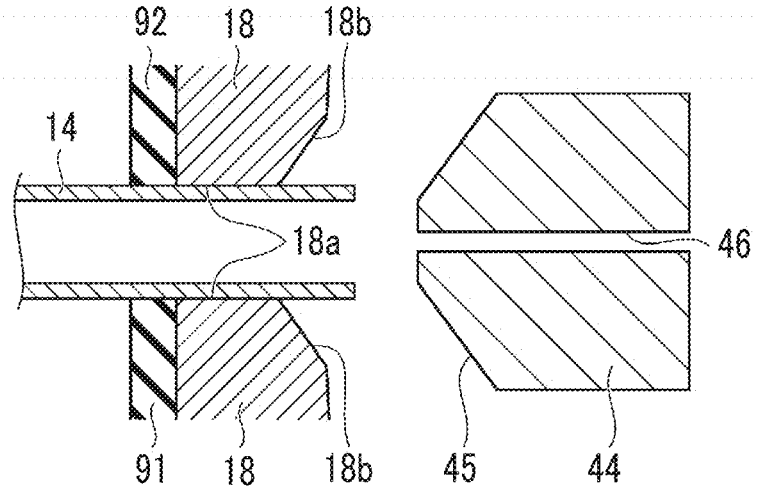
FIG. 4A is a view showing a state where an electrode holds a metal pipe material.
Figure 4B:
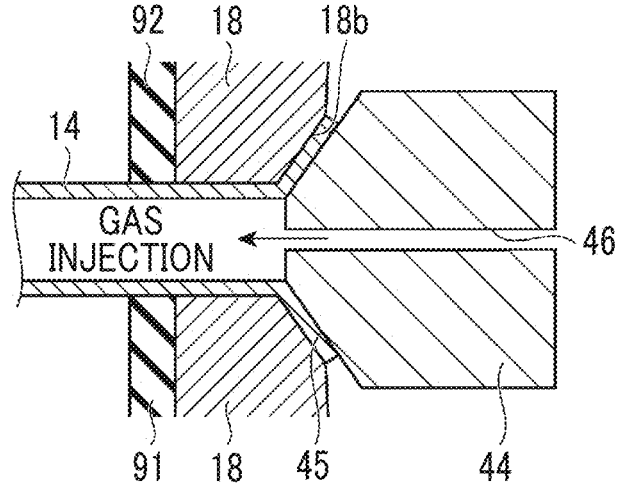
FIG. 4B is a view showing a state where a gas supply nozzle is in contact with the electrode.
Figure 4C:
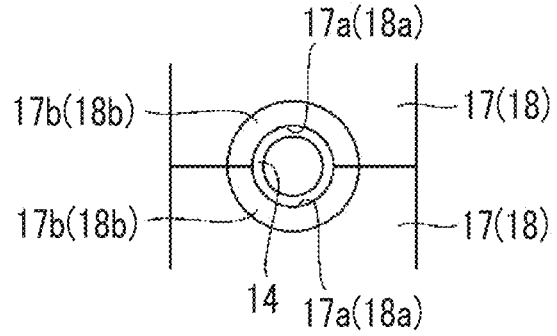
FIG. 4C is a front view of the electrode.

On the upper surface of the lower electrodes 17 and 18, semi-arc-shaped concave grooves 17*a* and 18*a* corresponding to the outer peripheral surface on the lower side of the metal pipe material 14 are respectively formed (refer to FIG. 4C). Therefore, the pair of lower electrodes 17 and 18 positioned on the lower die 11 side configures a part of the pipe holding mechanism 30, and can support the metal pipe material 14 to be moved up and down between the upper die 12 and the lower die 11. The metal pipe material 14 supported by the lower electrodes 17 and 18 is placed to be fitted into the concave grooves 17*a* and 18*a*, for example. On front surfaces (surfaces facing the outside of the die) of the lower electrodes 17 and 18, tapered concave surfaces 17*b* and 18*b*, which are recessed with peripheries thereof inclined to form a tapered shape toward the concave grooves 17*a* and 18*a*, are formed. The insulating material 91 communicates with the concave grooves 17*a* and 18*a*, and has a semi-arc-shaped concave groove corresponding to the outer peripheral surface of the metal pipe material 14.

The upper die 12 is configured with a large steel block similar to the lower die 11, and is fixed to a slide 81 (details thereof will be described later) that configures the drive mechanism 80. A cavity 24 is formed on the lower surface of the upper die 12. The cavity 24 is provided at a position facing the cavity 16 of the lower die 11. A cooling water passage 25 is provided inside the upper die 12.

Similar to the lower die 11, an electrode storage space 12*a* is provided in the vicinity of the left and right ends (left and right ends in FIG. 3) of the upper die 12. In the electrode storage space 12*a*, similar to the lower die 11, electrodes (upper electrodes) 17 and 18 configured to be capable of advancing and retreating upward and downward are provided. Insulating materials 92 for preventing energization are respectively provided between the upper die 12 and the upper electrode 17 and above the upper electrode 17, and between the upper die 12 and the upper electrode 18 and above the upper electrode 18. Each of the insulating materials 92 is fixed to an advancing and retreating rod 96, which is a movable portion of an actuator (not shown) that configures the pipe holding mechanism 30. The actuator is for moving the upper electrodes 17 and 18 or the like upward or downward and a fixation portion of the actuator is held on the drive mechanism 80 side together with the upper die 12.

On the lower surface of the upper electrodes 17 and 18, the semi-arc-shaped concave grooves 17*a* and 18*a* corresponding to the outer peripheral surface on the upper side of the metal pipe material 14 are respectively formed (refer to FIG. 4C). Therefore, the upper electrodes 17 and 18 configure another part of the pipe holding mechanism 30. When the metal pipe material 14 is sandwiched in the up-down direction by the pair of upper and lower electrodes 17 and 18, the outer periphery of the metal pipe material 14 can be surrounded so as to come into close contact with the entire periphery. On front surfaces (surfaces facing the outside of the die) of the upper electrodes 17 and 18, the tapered concave surfaces 17*b* and 18*b*, which are recessed with peripheries thereof inclined to form a tapered shape toward the concave grooves 17*a* and 18*a*, are formed. The insulating material 92 communicates with the concave grooves 17*a* and 18*a*, and has a semi-arc-shaped concave groove corresponding to the outer peripheral surface of the metal pipe material 14.

Figure 5A:
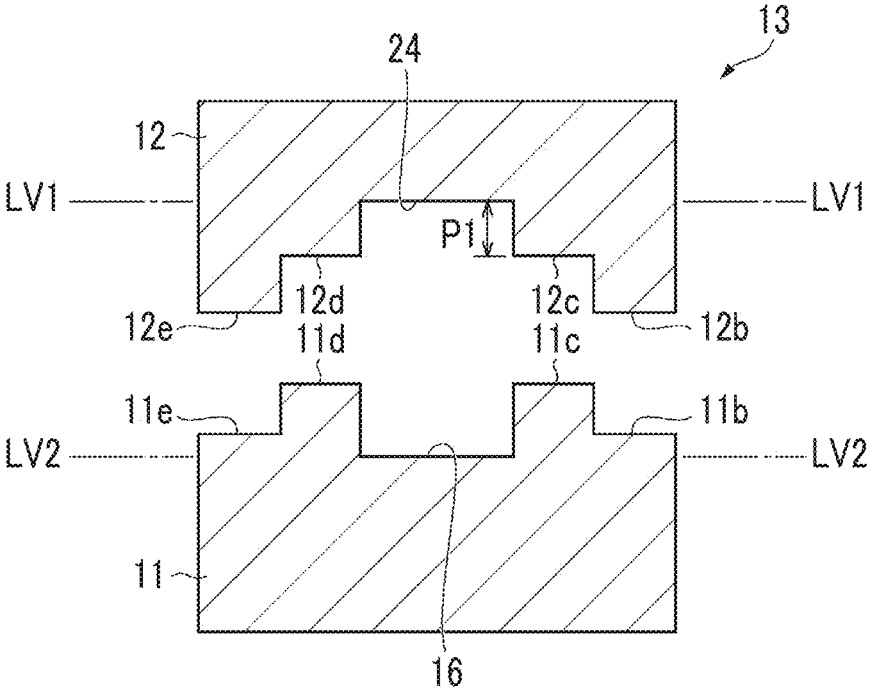
FIGS. 5A and 5B are schematic sectional views of a forming die.
Figure 5B:
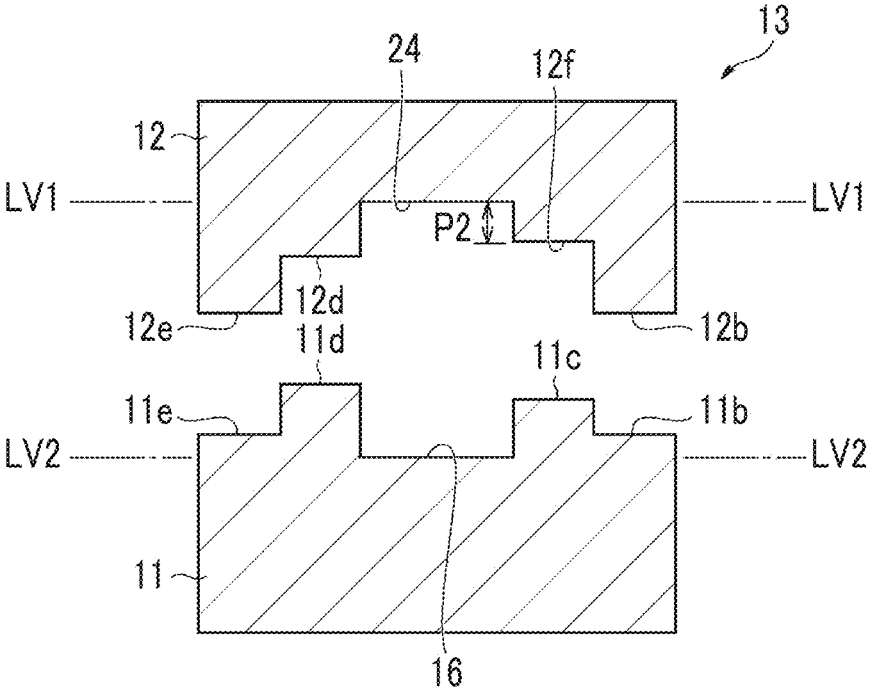

FIGS. 5A and 5B are schematic sectional views of the forming die 13. In the forming die 13, the portion shown in FIG. 5A corresponds to the portion that forms the cross section of the metal pipe 1 shown in FIG. 2A. In the forming die 13, the portion shown in FIG. 5B corresponds to the portion that forms the cross section of the metal pipe 1 shown in FIGS. 2B and 2C. As shown in FIGS. 5A to 5B, steps are provided on both the upper surface of the lower die 11 and the lower surface of the upper die 12.

On the upper surface of the lower die 11, when the surface of the cavity 16 at the center of the lower die 11 is defined as a reference line LV2, the step is formed by a first protrusion 11*b*, a second protrusion 11*c*, a third protrusion 11*d*, and a fourth protrusion 11*e*. The first protrusion lib and the second protrusion 11*c* are formed on the right side (the right side in FIGS. 5A and 5B and the rear side of the paper surface in FIG. 3) of the cavity 16, and the third protrusion 11*d* and the fourth protrusion 11*e* are formed on the left side (the left side in FIGS. 5A and 5B and the front side of the paper surface in FIG. 3) of the cavity 16. The second protrusion 11*c* is positioned between the cavity 16 and the first protrusion lib. The third protrusion 11*d* is positioned between the cavity 16 and the fourth protrusion 11*e*. The second protrusion 11*c* and the third protrusion 11*d* respectively protrude toward the upper die 12 side from the first protrusion 11*b* and the fourth protrusion 11*e*. Protrusion amounts of the first protrusion 11*b* and the fourth protrusion 11*e* from the reference line LV2 are approximately the same as each other, and protrusion amounts of the second protrusion 11*c* and the third protrusion 11*d* from the reference line LV2 are approximately the same as each other.

As shown in FIG. 5A, on the lower surface of the upper die 12, when the surface of the cavity 24 at the center of the upper die 12 is defined as a reference line LV1, the step is formed by a first protrusion 12*b*, a second protrusion 12*c*, a third protrusion 12*d*, and a fourth protrusion 12*e*. The first protrusion 12*b* and the second protrusion 12*c* are formed on the right side of the cavity 24, and the third protrusion 12*d* and the fourth protrusion 12*e* are formed on the left side of the cavity 24. The second protrusion 12*c* is positioned between the cavity 24 and the first protrusion 12*b*. The third protrusion 12*d* is positioned between the cavity 24 and the fourth protrusion 12*e*. The first protrusion 12*b* and the fourth protrusion 12*e* respectively protrude toward the lower die 11 side from the second protrusion 12*c* and the third protrusion 12*d*. Protrusion amounts of the first protrusion 12*b* and the fourth protrusion 12*e* from the reference line LV1 are approximately the same as each other, and protrusion amounts of the second protrusion 12*c* and the third protrusion 12*d* from the reference line LV1 are approximately the same as each other.

As shown in FIG. 5B, on the lower surface of the upper die 12, there is a location where a fifth protrusion 12*f* is formed instead of the second protrusion 12*c*. When the protrusion amount of the second protrusion 12*c* is a protrusion amount P1 and the protrusion amount of the fifth protrusion 12*f* is a protrusion amount P2, the protrusion amount P2 is smaller than the protrusion amount P1. The second protrusion 12*c* and the fifth protrusion 12*f* in the upper die 12 are alternately provided, for example, in the longitudinal direction X of the metal pipe 1.

The first protrusion 12*b* of the upper die 12 faces the first protrusion 11*b* of the lower die 11, the second protrusion 12*c* and the fifth protrusion 12*f* of the upper die 12 face the second protrusion 11*c* of the lower die 11, the cavity 24 of the upper die 12 faces the cavity 16 of the lower die 11, the third protrusion 12*d* of the upper die 12 faces the third protrusion 11*d* of the lower die 11, and the fourth protrusion 12*e* of the upper die 12 faces the fourth protrusion 11*e* of the lower die 11. Accordingly, a space is formed when the upper die 12 and the lower die 11 are fitted respectively between the second protrusion 12*c* and the fifth protrusion 12*f* of the upper die 12 and the second protrusion 11*c* of the lower die 11 and between the third protrusion 12*d* of the upper die 12 and the third protrusion 11*d* of the lower die 11. A space is formed when the upper die 12 and the lower die 11 are fitted between the cavity 24 of the upper die 12 and the cavity 16 of the lower die 11.

Returning to FIG. 3, the drive mechanism 80 includes the slide 81 which moves the upper die 12 such that the upper die 12 and the lower die 11 are combined to each other, a shaft 82 which generates a driving force for moving the slide 81, and a connecting rod 83 for transmitting the driving force generated by the shaft 82 to the slide 81. The shaft 82 extends in the left-right direction above the slide 81, is supported to be rotatable, and includes an eccentric crank 82*a* which protrudes from left and right ends at a position separated from the axial center of the shaft 82 and extends in the left-right direction. The eccentric crank 82*a* and a rotary shaft 81*a* which is provided above the slide 81 and extends in the left-right direction are connected to each other by the connecting rod 83. In a case of the drive mechanism 80, the upward and downward movement of the slide 81 can be controlled by the controller 70 that controls rotation of the shaft 82 such that the height of the eccentric crank 82*a* in the up-down direction is changed and the positional change of the eccentric crank 82*a* is transmitted to the slide 81 through the connecting rod 83. Here, oscillation (rotary motion) of the connecting rod 83 generated when the positional change of the eccentric crank 82*a* is transmitted to the slide 81 is absorbed by the rotary shaft 81*a*. Note that, the shaft 82 is rotated or stopped in accordance with the driving of a motor or the like controlled by the controller 70, for example.

The heating mechanism (power supply portion) 50 includes a power supply source 55 and a power supply line 52 which electrically connects the power supply source 55 and the electrodes 17 and 18 to each other. The power supply source 55 includes a DC power source and a switch, and can energize the metal pipe material 14 through the power supply line 52 and the electrodes 17 and 18. In the present embodiment, the power supply line 52 is connected to the lower electrodes 17 and 18, but the present disclosure is not limited thereto. The controller 70 can control the heating mechanism 50 such that the metal pipe material 14 is heated to a quenching temperature (for example, equal to or higher than an AC3 transformation point temperature).

Each of the pair of gas supply portions 40 includes a cylinder unit 42 that is placed and fixed on the base stage 15 through a block 41, a cylinder rod 43 that advances and retreats in accordance with the operation of the cylinder unit 42, and a gas supply nozzle 44 connected to the tip of the cylinder rod 43. The cylinder unit 42 is a portion that drives the gas supply nozzle 44 to advance and retreat with respect to the metal pipe material 14 through the cylinder rod 43. The gas supply nozzle 44 is a portion configured to be capable of communicating with the inside of the metal pipe material 14 held by the pipe holding mechanism 30, and supplies a gas for expansion forming to the inside. The gas supply nozzle 44 includes a tapered surface 45 provided so that the tip thereof is tapered, a gas passage 46 provided on the inside thereof, and an on-off valve 47 positioned at the outlet of the gas passage 46. The tapered surface 45 is formed in a shape that can be exactly fitted to and in contact with the tapered concave surfaces 17*b* and 18*b* of the electrodes 17 and 18 (refer to FIG. 4B). The tapered surface 45 may be made of an insulating material. Although not shown, at least one of the gas supply nozzles 44 may be provided with an exhaust mechanism for exhausting the gas in the gas passage 46. The gas passage 46 is connected to a second tube 67 of the gas supply unit 60 through the on-off valve 47. Therefore, the gas supplied from the gas supply unit 60 is supplied to the gas passage 46. The on-off valve 47 is directly attached to the outside of the gas supply nozzle 44 and controls the gas supply from the gas supply unit 60 to the gas passage 46. By closing the on-off valve 47 and controlling a pressure control valve 68, gas may be supplied from a gas source 61 to the second tube 67 to increase the internal pressure thereof in advance. In this case, after the on-off valve 47 is opened, the pressure in the gas passage 46 can rapidly increase. Accordingly, the pressure inside the metal pipe material 14 that communicates with the gas passage 46 can also rapidly increase. The opening and closing of the on-off valve 47 is controlled by the controller 70 through (B) shown in FIG. 3.

The gas supply unit 60 includes the gas source 61, an accumulator (gas storage unit) 62 in which the gas supplied by the gas source 61 is stored, a first tube 63 which extends from the accumulator 62 to the cylinder unit 42 of the gas supply portion 40, a pressure control valve 64 and a switching valve 65 which are provided in the first tube 63, the second tube (pipe) 67 which extends from the accumulator 62 to the gas supply nozzle 44 of the gas supply portion 40, and a pressure control valve 68 and a check valve 69 which are provided in the second tube 67. The pressure control valve 64 plays a role of supplying a gas, which has an operation pressure applied to a pressing force against the metal pipe material 14 of the gas supply nozzle 44, to the cylinder unit 42. The check valve 69 plays a role of preventing the gas from backflowing in the second tube 67.

The pressure control valve 68 is a valve that adjusts the pressure in the second tube 67 under the control of the controller 70. For example, the pressure control valve 68 plays a role of supplying a gas (hereinafter, referred to as low-pressure gas) having an operation pressure (hereinafter, referred to as first ultimate pressure) for temporarily expanding the metal pipe material 14, and a gas (hereinafter, referred to as high-pressure gas) having an operation pressure (hereinafter, referred to as second ultimate pressure) for forming the metal pipe, into the second tube 67. Accordingly, the low-pressure gas and the high-pressure gas can be supplied to the gas supply nozzle 44 connected to the second tube 67. The pressure of the high-pressure gas is, for example, approximately 2 to 5 times that of the low-pressure gas.

With the information transmitted from (A) shown in FIG. 3, the controller 70 acquires temperature information from the thermocouple 21 and controls the heating mechanism 50 and the drive mechanism 80. The water circulation mechanism 72 includes a water tank 73 which collects water, a water pump 74 which pumps up the water collected in the water tank 73 and pressurizes the water and sends the water to the cooling water passage 19 of the lower die 11 and the cooling water passage 25 of the upper die 12, and a pipe 75. Although omitted, a cooling tower for lowering the water temperature and a filter for purifying the water may be interposed in the pipe 75.

Metal Pipe Forming Method Using Forming Apparatus

Figure 6A:
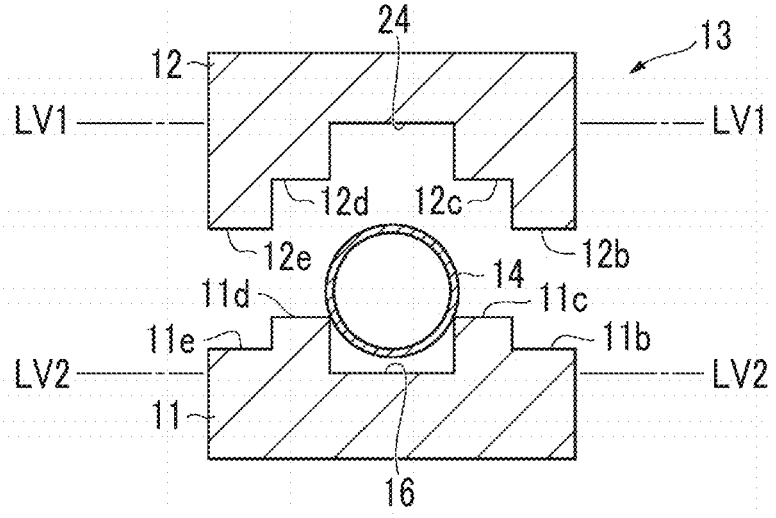
FIGS. 6A to 6C are views showing an operation of the forming die and a change in shape of the metal pipe material.

Next, an example of the forming method of the metal pipe 1 using the forming apparatus 10 will be described with reference to FIGS. 6A to 6C. First, as shown in FIG. 6A, the metal pipe material 14 that is heated and has a hollow shape is disposed between the upper die 12 and the lower die 11. Specifically, the metal pipe material 14 is disposed between the cavity 24 of the upper die 12 and the cavity 16 of the lower die 11. The metal pipe material 14 is sandwiched by the upper electrodes 17 and 18 and the lower electrodes 17 and 18 of the pipe holding mechanism 30. Further, the metal pipe material 14 is energized and heated by controlling the heating mechanism 50 by the controller 70. Specifically, electric power is supplied to the metal pipe material 14 by controlling the heating mechanism 50 by the controller 70. As a result, the electric power transmitted to the lower electrodes 17 and 18 through the power supply line 52 is supplied to the upper electrodes 17 and 18 that sandwich the metal pipe material 14 and the metal pipe material 14. Then, due to an electric resistance of the metal pipe material 14 itself, the metal pipe material 14 itself generates heat by Joule heat.

Figure 6B:
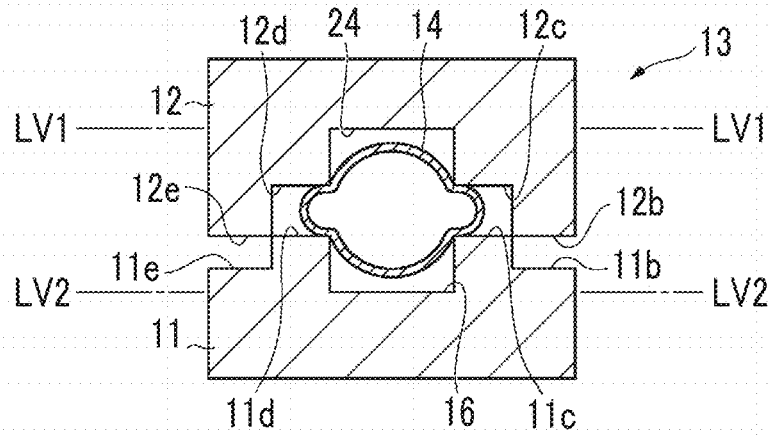

Next, as shown in FIG. 6B, the upper die 12 is moved toward the lower die 11 by controlling the drive mechanism 80 by the controller 70. Accordingly, the upper die 12 and the lower die 11 are brought close to each other, and a space for forming the metal pipe 1 is formed between the upper die 12 and the lower die 11. At this time, the metal pipe material 14 disposed between the upper die 12 and the lower die 11 is positioned in the cavity 16. In the present embodiment, apart of the metal pipe material 14 is deformed by coming into contact with the upper die 12 and the lower die 11, but the present disclosure is not limited thereto. The upper die 12 may be brought closer to the lower die 11 side before the metal pipe material 14 is energized and heated.

Figure 6C:
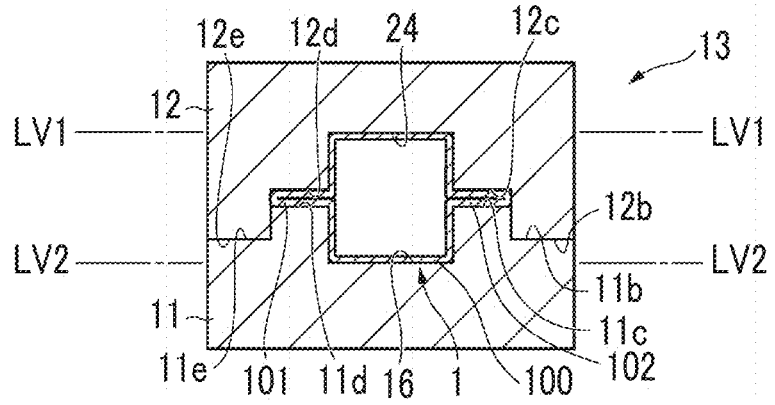

Next, as shown in FIG. 6C, the metal pipe material 14 is expanded by supplying a gas, the metal pipe material 14 is brought into contact with the upper die 12 and the lower die 11, and accordingly, the metal pipe 1 including the pipe portion 100 and the flange portions 101 and 102 is formed. Specifically, first, by operating the cylinder unit 42 of the gas supply portion 40, the gas supply nozzle 44 is advanced, and the gas supply nozzles 44 are inserted into both ends of the metal pipe material 14. At this time, the tips of each of the gas supply nozzles 44 are inserted into both ends of the metal pipe material 14 to seal the metal pipe material 14. Accordingly, the inside of the metal pipe material 14 and the gas passage 46 communicate with each other with high airtightness. Subsequently, the gas is supplied into the heated metal pipe material 14 by controlling the gas supply unit 60, the drive mechanism 80, and the on-off valve 47 by the controller 70. Accordingly, the metal pipe material 14 softened by heating expands and comes into contact with the forming die 13. Then, the expanded metal pipe material 14 is formed so as to follow the shapes of the cavities 16 and 24, the second protrusions 11*c* and 12*c*, and the third protrusions 11*d* and 12*d*. As described above, the pipe portion 100 is formed. The upper die 12 is further moved toward the lower die 11 by controlling the drive mechanism 80 by the controller 70. Accordingly, in the expanded metal pipe material 14, the portions that have entered the space provided between the second protrusions 11*c* and 12*c* and the space provided between the third protrusions 11*d* and 12*d* are crushed by the upper die 12 and the lower die 11.

Figure 7:
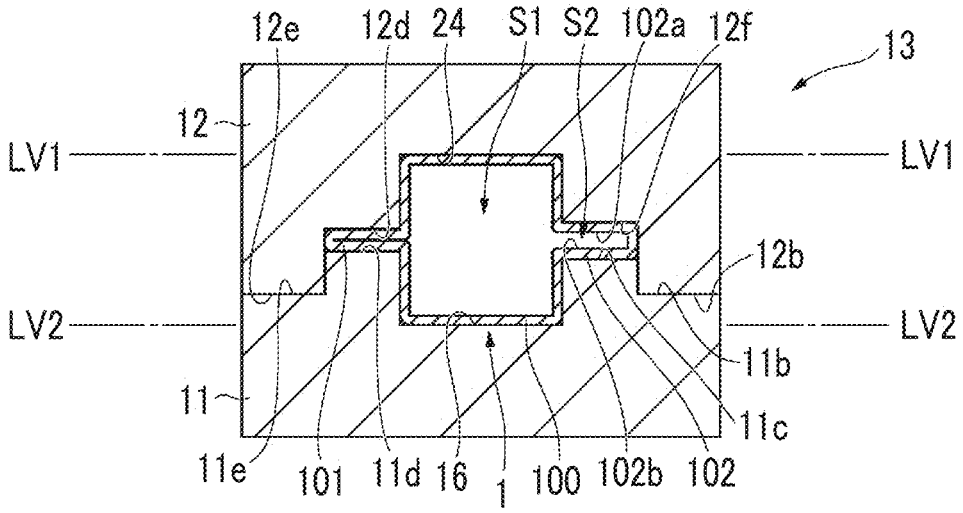
FIG. 7 is a view showing the operation of the forming die and the change in shape of the metal pipe material.

When the flange portion 102 is formed, the portion that has entered between the second protrusion 11*c* and the fifth protrusion 12*f* in the expanded metal pipe material 14 is formed following the shapes of only the first protrusion 12*b*, the second protrusion 11*c*, and the fifth protrusion 12*f*, as shown in FIG. 7. In other words, the portion that has entered the space is not crushed by the second protrusion 11*c* and the fifth protrusion 12*f*. Therefore, at the portion formed between the second protrusion 11*c* and the fifth protrusion 12*f* in the flange portion 102, unlike the portion formed between the second protrusions 11*c* and 12*c*, the gap S2 which is positioned between the pair of inner surfaces 102*a* and 102*b* and communicates with the internal space S1 of the pipe portion 100, is provided. As described above, since the second protrusion 12*c* and the fifth protrusion 12*f* are provided alternately in the longitudinal direction X, the plurality of gaps S2 are provided intermittently in the longitudinal direction X. The pair of inner surfaces 102*a* and 102*b* are in close contact with each other between the gaps S2 adjacent to each other along the longitudinal direction X.

The outer peripheral surface of the blow-formed and expanded metal pipe material 14 comes into contact with the lower die 11 and the upper die 12 and is rapidly cooled. Accordingly, the metal pipe material 14 is quenched. The upper die 12 and the lower die 11 have a large heat capacity and are managed at a low temperature. Therefore, the heat of the pipe surface is rapidly taken to the die side as the metal pipe material 14 comes into contact with the upper die 12 and the lower die 11. The above-described cooling method is referred to as die contact cooling or die cooling. Immediately after being rapidly cooled, austenite transforms into martensite (hereinafter, transformation from austenite to martensite is referred to as martensitic transformation). The cooling speed is set to be low in a second half of the cooling, and thus, martensite transforms into another structure (such as troostite, sorbite, or the like) due to recuperation. Therefore, it is not necessary to separately perform tempering treatment. In the present embodiment, the cooling may be performed by supplying a cooling medium into, for example, the cavities 16 and 24, instead of or in addition to the die cooling. For example, cooling may be performed by bringing the metal pipe material 14 into contact with the dies (the upper die 12 and the lower die 11) until a temperature at which the martensitic transformation starts is reached, and the dies may be opened thereafter with a cooling medium (cooling gas) blown onto the metal pipe material 14 such that martensitic transformation occurs.

After the metal pipe 1 is formed, the metal pipe 1 is carried out from the forming apparatus 10. For example, the metal pipe 1 is carried out from the forming apparatus 10 by using a robot arm or the like. Then, the through-hole 110 connected to the gap S2 is provided in the flange portion 102 (refer to FIG. 2C). For example, by performing punching processing such as laser processing or the machining processing to the flange portion 102, the through-hole 110 is formed. In the present embodiment, the through-holes 110 are provided for each of the plurality of gaps S2, but the present disclosure is not limited thereto.

Figure 10:
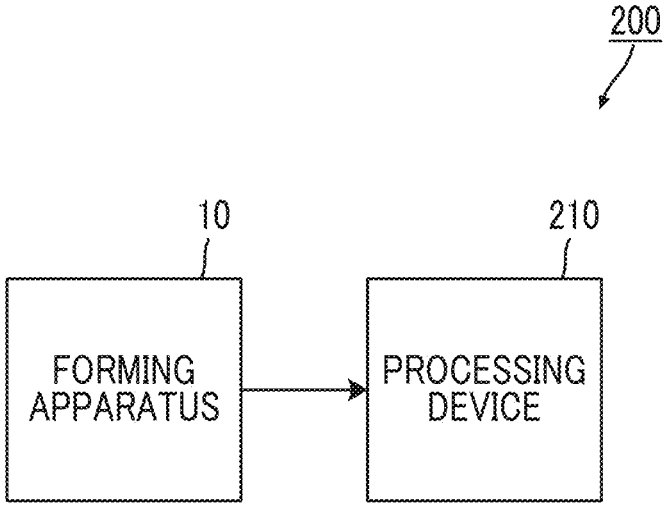
FIG. 10 is a conceptual view showing a forming system.

Specifically, as shown in FIG. 10, a forming system 200 includes the above-described forming apparatus 10 and a processing device 210 (processing unit) for providing the through-hole in the metal pipe 1. Therefore, in the processing device 210, the through-hole 110 connected to the gap S2 is provided in the flange portion 102.

By going through the above-described steps, the metal pipe 1 having the pipe portion 100 and the flange portions 101 and 102 can be formed. The time from the blow forming of the metal pipe material 14 to the completion of forming of the metal pipe 1 is approximately several seconds to several tens of seconds, although the time depends on the type of the metal pipe material 14. By changing the shapes of the cavities 16 and 24, it is possible to form a pipe portion having any shape such as a circular cross section, an elliptical cross section, and a polygonal cross section.

Effects

According to the metal pipe 1 formed by the forming method according to the above-described present embodiment, the gap S2 that communicates with the internal space S1 of the pipe portion 100 is positioned between the pair of inner surfaces 102*a* and 102*b* of the flange portion 102. The through-hole 110 provided in the flange portion 102 is connected to the gap S2. Accordingly, for example, even in a case where a liquid such as water has entered the internal space S1 of the pipe portion 100 when coating the metal pipe 1, the liquid can be easily discharged through the gap S2 and the through-hole 110. Thereby, the liquid is less likely to be collected inside the metal pipe 1, and thus, the generation of rust on the metal pipe 1 can be suppressed. In addition, for example, when the metal pipe 1 is immersed in the coating liquid, the through-hole 110 becomes an air escape hole. Accordingly, the inner peripheral surface 100*a* and the like of the pipe portion 100 can be excellently coated. Furthermore, it is possible to suppress the occurrence of collection of the coating liquid on the inner peripheral surface 100*a* or the like.

In the present embodiment, in the forming of the metal pipe 1, the plurality of gaps S2 positioned between the pair of inner surfaces 102*a* and 102*b* and intermittently disposed along the longitudinal direction X of the pipe portion 100 are formed, and the pair of inner surfaces 102*a* and 102*b* are in close contact with each other between the gaps S2 adjacent to each other along the longitudinal direction X. Therefore, the portion where the pair of inner surfaces 102*a* and 102*b* are in close contact with each other, and another member can be spot-welded. In addition, by the formation of the plurality of gaps S2 inside the flange portion 102, the liquid is less likely to be collected in the internal space S1 of the pipe portion 100. Therefore, it is possible to suppress the occurrence of intensity deterioration of the pipe portion 100, which is the main body of the metal pipe 1.

In the present embodiment, in the flange portion 102, the through-holes 110 may be provided for each of the plurality of gaps S2. In this case, it is possible to excellently suppress the collection of liquid inside the metal pipe 1.

The forming system 200 according to the embodiment includes: the metal pipe material 14 having a hollow shape; the forming apparatus 10 that is disposed between the upper die 12 and the lower die 11, expands the metal pipe material 14 by supplying a fluid, brings the metal pipe material 14 into contact with the upper die 12 and the lower die 11, and accordingly, forms the metal pipe 1 having the pipe portion 100 and the flange portion 101; and the processing device 210 that provides the through-hole 110 in the metal pipe 1, in which the forming apparatus 10 forms a gap which is positioned between the pair of inner surfaces of the flange portion 101 and communicates with the internal space of the pipe portion 100, and the processing device 210 provides the through-hole 110 connected to the gap in the flange portion 101.

According to the forming system 200, it is possible to obtain the action and effects having the same meaning as those of the above-described forming method.

MODIFICATION EXAMPLE

Hereinafter, the metal pipe according to a modification example of the above-described embodiment will be described. In the description of the modification example, the description overlapping with the above-described embodiment will be omitted, and the portion different from the above-described embodiment will be described.

Figure 8:
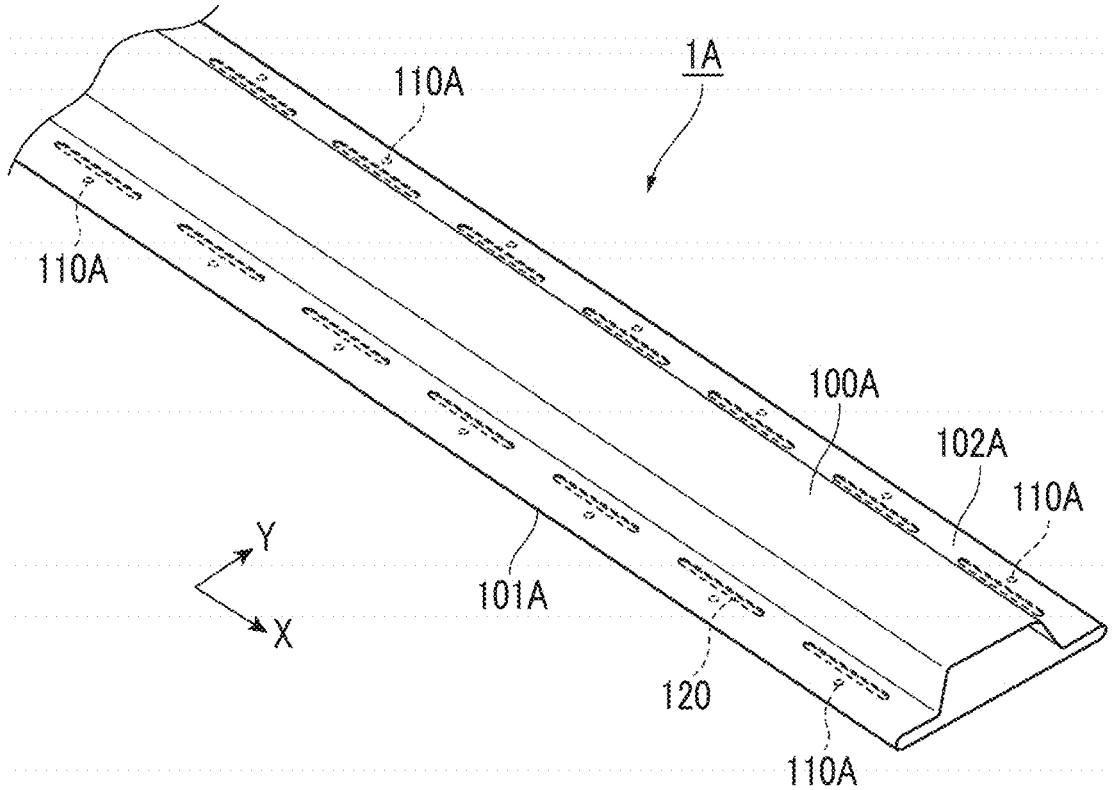
FIG. 8 is a schematic perspective view showing a metal pipe according to a modification example.
Figure 9A:
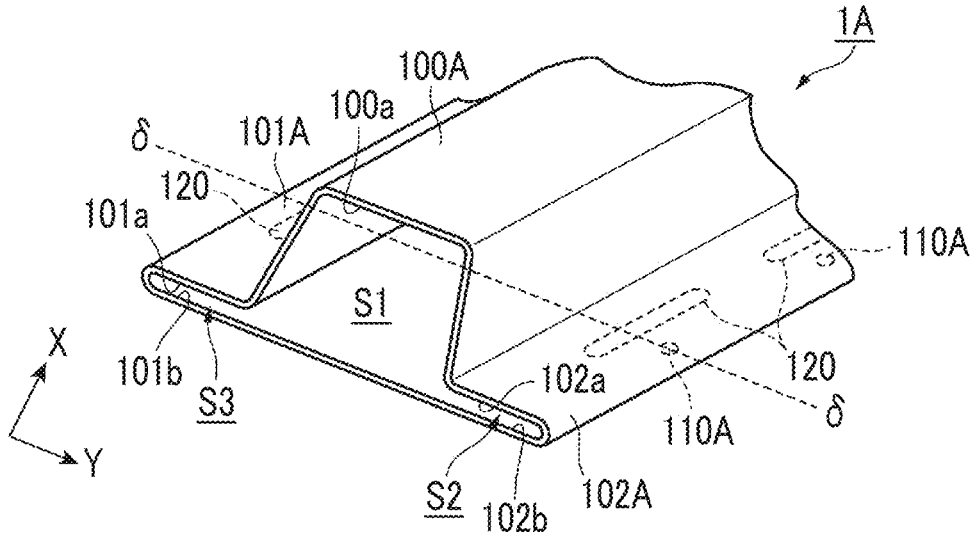
FIG. 9A is an enlarged perspective view of a main part of FIG. 8.
Figure 9B:
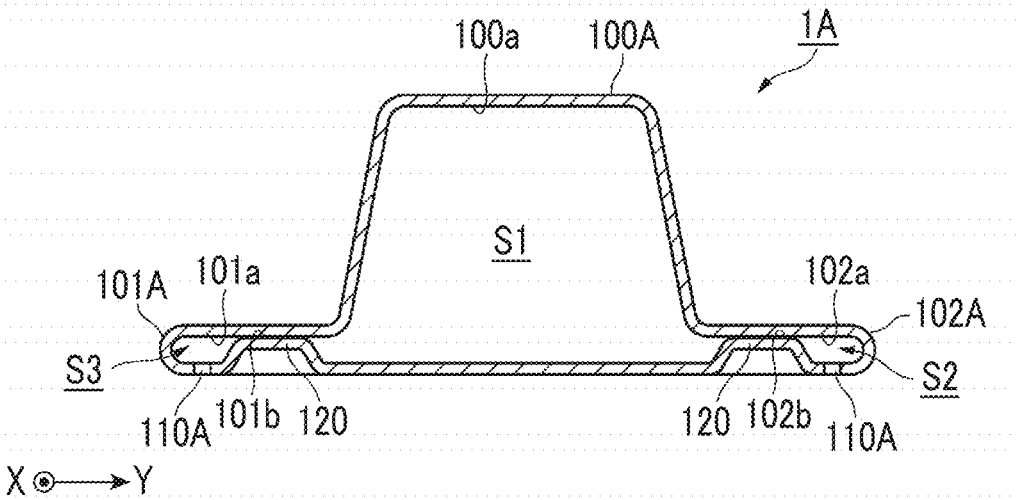
FIG. 9B is a sectional view taken along line δ-δ of FIG. 9A.
Figure 9C:
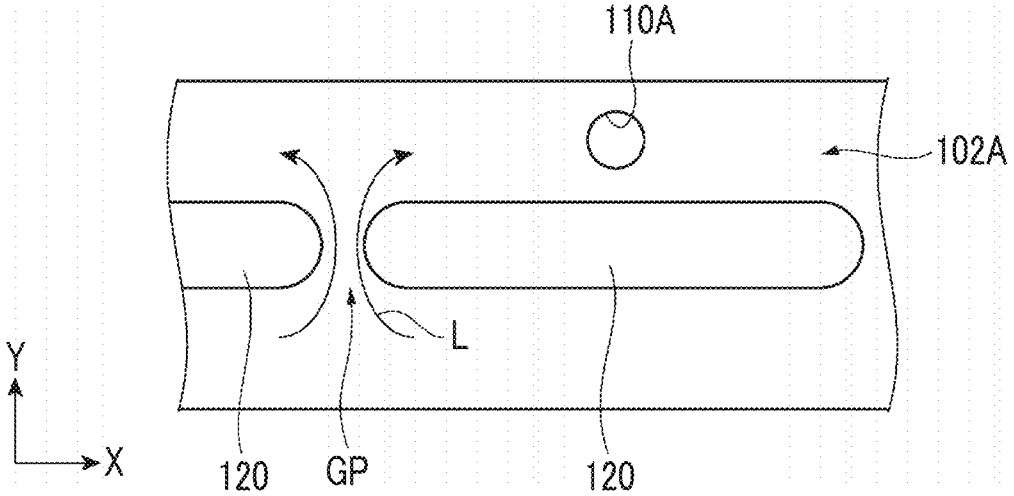
FIG. 9C is a schematic view showing a flow of a liquid in a flange portion.

FIG. 8 is a schematic perspective view showing the metal pipe according to the modification example. FIG. 9A is an enlarged perspective view of a main part of FIG. 8, FIG. 9B is a sectional view taken along line 5-5 of FIG. 9A, and FIG. 9C is a schematic view showing a flow of the liquid in the flange portion. A metal pipe 1A shown in FIGS. 8 and 9A to 9C is a hollow member having a substantially hat shape in cross section, and is a formed product of a single metal pipe material. A pipe portion 100A of the metal pipe 1A has a substantially trapezoidal cross section. In the metal pipe 1A, flange portions 101A and 102A are formed so as to be connected to the bottom surface in the cross section of the pipe portion 100A. In the present modification example, the bottom surface is continuous with the inner surface 101*b* of the flange portion 101A and the inner surface 102*b* of the flange portion 102A.

In the present modification example, the gap S2 is provided in the entire flange portion 102A. In addition, the flange portion 101A is also provided with a gap S3 as a whole. In other words, the gap S3 is provided between the inner surfaces 101*a* and 101*b* of the flange portion 101A. Therefore, each of the gaps S2 and S3 is continuously provided along the longitudinal direction X.

A part of the inner surface 101*b* of the flange portion 101A is provided with a protrusion portion 120 that protrudes toward the inner surface 101*a*. Accordingly, the part of the inner surface 101*b* is in close contact with the inner surface 101*a*. Similarly, apart of the inner surface 102*b* of the flange portion 102A is provided with the protrusion portion 120 that protrudes toward the inner surface 102*a*, and the part is in close contact with the inner surface 102*a*. Accordingly, the intensity of the metal pipe 1A can be improved. In the present modification example, each of the locations where the inner surfaces 101*a* and 101*b* are in close contact with each other and the location where the inner surfaces 102*a* and 102*b* are in close contact with each other can function as a spot-welded portion with other member. The dimension of the protrusion portion 120 along the longitudinal direction X is, for example, 10% or more and 50% or less of the dimension of the metal pipe 1A along the longitudinal direction X. The dimension of the protrusion portion 120 along the transverse direction Y is not particularly limited, but is appropriately adjusted according to the dimension of the protrusion portion 120 along the longitudinal direction X and the like.

A plurality of protrusion portions 120 are provided on each of the flange portions 101A and 102A. In the present modification example, the plurality of protrusion portions 120 provided on the flange portion 101A are provided at regular intervals along the longitudinal direction X, but the present disclosure is not limited thereto. Similarly, the plurality of protrusion portions 120 provided on the flange portion 102A are provided at regular intervals along the longitudinal direction X, but the present disclosure is not limited thereto. The protrusion portions 120 adjacent to each other in the longitudinal direction X are separated from each other.

Each of the protrusion portions 120 is formed, for example, by pressing the flange portions 101A and 102A after forming the metal pipe 1A. Otherwise, each of the protrusion portions 120 may be provided, for example, when forming the metal pipe 1A. In this case, for example, a protrusion is provided at a part of the surface of the second protrusion 11*c* of the lower die 11. Accordingly, the protrusion portion 120 can be formed when the flange portions 101A and 102A are formed.

The through-hole 110A is provided on each of the flange portions 101A and 102A. The through-hole 110A is an opening connected to the gap S2 or the gap S3, and is provided so as to penetrate the inner surfaces 101*b* and 102*b*. The through-holes 110A provided in the flange portions 101A and 102A are positioned on the opposite side of the pipe portion 100A with the protrusion portion 120 therebetween in the transverse direction Y. In this case, the liquid is less likely to be collected on the tip end side (particularly, in the vicinity of the protrusion portion 120 from the viewpoint of surface tension) of the flange portions 101A and 102A. In addition, as shown in FIG. 9C, for example, when the inside of the metal pipe 1A is coated with the coating liquid L, the coating liquid L is likely to wrap around the back side of the flange portion 102A through a gap GP between the protrusion portions 120.

In the present modification example, the through-hole 110A is provided corresponding to each of the protrusion portions 120, but the present disclosure is not limited thereto. The through-hole 110A may be provided in any of the flange portions 101A and 102A.

In the above-described modification example, the same effects as those in the above-described embodiment are exhibited. Since the gaps S2 and S3 are continuous in the longitudinal direction X, even in a case where the number of through-holes 110A formed in the flange portions 101A and 102A is reduced, the liquid can be excellently discharged through the gaps S2 and S3 and the through-holes 110A.

Although the preferred embodiments of the present disclosure have been described above, the present disclosure is not limited to the above-described embodiment and the above-described modification examples. The above-described embodiment and the above-described modification example may be a combination with each other. For example, the metal pipe may be provided with the flange portions 101A and 102, or may be provided with the flange portions 101 and 102A. Further, the metal pipe is provided with one flange portion, or may be provided with three or more flange portions.

In the above-described embodiment and the above-described modification example, the through-hole is provided after forming the metal pipe, but the present disclosure is not limited thereto. The through-hole may be provided when forming the metal pipe.

In the above-described embodiment, the gap is provided only in one flange portion, but the present disclosure is not limited thereto. For example, the gap may be provided in both of the flange portions. In this case, through-holes may be provided in both of the flange portions.

In the above-described modification example, the flange portion is provided with the protrusion portion that protrudes from one inner surface toward the other inner surface, but the present disclosure is not limited thereto. For example, the protrusion portion that protrudes from the other inner surface toward one inner surface may be provided on the flange portion. Otherwise, the flange portion may be provided with both the protrusion portion that protrudes from one inner surface toward the other inner surface, and the protrusion portion that protrudes from the other inner surface toward one inner surface. The close contact between one inner surface and the other inner surface may be configured with the protrusion portion that protrudes from one inner surface toward the other inner surface and the protrusion portion that protrudes from the other inner surface toward one inner surface. The through-hole is provided on the opposite side of the pipe portion through the protrusion portion, but the present disclosure is not limited thereto.

In the above-described embodiment, gas is exemplified as the fluid to be supplied to the metal pipe material, but a liquid may be adopted as the fluid. The metal pipe material does not need to be heated during the forming. In other words, the metal pipe may be formed with hydrofoam.

In the example of the forming system 200 shown in FIG. 10, the processing device 210 is provided at a location different from that of the forming apparatus 10, and the processing device 210 forms the through-hole. Instead of this, the processing unit capable of providing a through-hole may be incorporated in the forming apparatus 10.

It should be understood that the invention is not limited to the above-described embodiment, but may be modified into various forms on the basis of the spirit of the invention. Additionally, the modifications are included in the scope of the invention.

What is claimed is:

1. A metal pipe forming method comprising:

disposing a metal pipe material having a hollow shape between a pair of dies; and forming a metal pipe including a pipe portion and a flange portion by expanding the metal pipe material by supplying a fluid and bringing the metal pipe material into contact with the pair of dies, wherein in the forming of the metal pipe, a first region including a gap which is positioned between a pair of inner surfaces of the flange portion and communicates with an internal space of the pipe portion is formed, the first region of the flange portion is provided with a through-hole connected to the gap, in the forming of the metal pipe, a plurality of the first regions intermittently disposed along an axial direction of the pipe portion are formed, and a second region is formed between the first regions adjacent to each other along the axial direction, in which the pair of inner surfaces of the flange portion are in close contact with each other up to a tip of the flange portion.

2. The metal pipe forming method according to claim 1, wherein the flange portion is provided with the through-hole for each of the plurality of first regions.

3. A metal pipe forming system comprising:

a forming unit that forms a metal pipe including a pipe portion and a flange portion by disposing a metal pipe material having a hollow shape between a pair of dies, expanding the metal pipe material by supplying a fluid, and bringing the metal pipe material into contact with the pair of dies; and a processing unit that provides a through-hole in the metal pipe, wherein the forming unit forms a first region including a gap which is positioned between a pair of inner surfaces of the flange portion and communicates with an internal space of the pipe portion, the processing unit provides the through-hole connected to the gap in the first region of the flange portion, and the forming unit forms a plurality of the first regions intermittently disposed along an axial direction of the pipe portion, and a second region between the first regions adjacent to each other along the axial direction, in which the pair of inner surfaces of the flange portion are in close contact with each other up to a tip of the flange portion.

4. The metal pipe forming system according to claim 3, further comprising:

a power supply portion that energizes and heats the metal pipe material.

5. The metal pipe forming system according to claim 4, wherein the power supply portion includes a power supply source and a power supply line which electrically connects the power supply source and an electrode to each other, and the power supply source includes a DC power supply and a switch, and energizes the metal pipe material through the power supply line and the electrode.

6. The metal pipe forming system according to claim 3, further comprising:

a gas supply unit for supplying a gas as the fluid into the metal pipe material; and a pair of gas supply portions for supplying the gas from the gas supply unit into the metal pipe material.

7. The metal pipe forming system according to claim 6, wherein the pair of gas supply portions includes a cylinder unit that is placed and fixed on a base stage, a cylinder rod that advances and retreats in accordance with an operation of the cylinder unit, and a gas supply nozzle connected to a tip of the cylinder rod.

8. The metal pipe forming system according to claim 7, wherein the gas supply nozzle includes a tapered surface provided so that a tip thereof is tapered, a gas passage provided inside the gas supply nozzle, and an on-off valve positioned at an outlet of the gas passage.

9. The metal pipe forming system according to claim 8, wherein the tapered surface is formed in a shape that can be fitted to and in contact with tapered concave surfaces of an electrode, the gas passage is connected to the gas supply unit through the on-off valve, and the on-off valve is attached to an outside of the gas supply nozzle and controls gas supply from the gas supply unit to the gas passage.

10. The metal pipe forming system according to claim 6, wherein the gas supply unit includes a gas source, a gas storage part in which a gas supplied by the gas source is stored, a first tube which extends from the gas storage part to the cylinder unit of the gas supply portion, a pressure control valve and a switching valve which are provided in the first tube, a second tube which extends from the gas storage part to a gas supply nozzle of the gas supply portion, and a pressure control valve and a check valve which are provided in the second tube.

11. The metal pipe forming system according to claim 3, further comprising:

a water circulation mechanism which water-cools the forming unit.

12. The metal pipe forming system according to claim 11, wherein the water circulation mechanism includes a water tank which collects water, a water pump which pumps up the water collected in the water tank, pressurizes the water, and sends the water to a cooling water passage of the pair of dies, and a pipe.

* * * * *